US010276976B1

(12) United States Patent
Phillips et al.

(10) Patent No.: US 10,276,976 B1
(45) Date of Patent: Apr. 30, 2019

(54) CARD EDGE CONNECTOR SYSTEM

(71) Applicant: TE CONNECTIVITY CORPORATION, Berwyn, PA (US)

(72) Inventors: Michael John Phillips, Camp Hill, PA (US); Randall Robert Henry, Lebanon, PA (US); Dean Marlin Harmon, III, Harrisburg, PA (US)

(73) Assignee: TE CONNECTIVITY CORPORATION, Berwyn, PA (US)

( * ) Notice: Subject to any disclaimer, the term of this patent is extended or adjusted under 35 U.S.C. 154(b) by 0 days.

(21) Appl. No.: 15/867,972

(22) Filed: Jan. 11, 2018

(51) Int. Cl.

| | |
|---|---|
| ***H01R 24/00*** | (2011.01) |
| ***H01R 13/627*** | (2006.01) |
| ***H01R 13/629*** | (2006.01) |
| ***H01R 12/72*** | (2011.01) |

(52) U.S. Cl.
CPC ..... *H01R 13/629* (2013.01); *H01R 12/721* (2013.01); *H01R 13/6275* (2013.01)

(58) Field of Classification Search
CPC .. H01R 13/62; H01R 13/6275; H01R 13/629; H01R 12/721
See application file for complete search history.

(56) References Cited

U.S. PATENT DOCUMENTS

| | | | | |
|---|---|---|---|---|
| 5,980,299 | A | 11/1999 | Davis | |
| 6,160,706 | A | 12/2000 | Davis et al. | |
| 6,162,069 | A * | 12/2000 | Choy | H01R 12/7005 439/92 |
| 6,319,035 | B1 * | 11/2001 | Choy | H01R 12/721 439/326 |
| 6,843,670 | B2 | 1/2005 | Yamaguchi et al. | |
| 6,893,281 | B2 * | 5/2005 | Taguchi | H01R 13/631 439/326 |
| 7,175,461 | B1 * | 2/2007 | Ju | H01R 12/7005 439/159 |
| 7,484,983 | B2 * | 2/2009 | Ju | H01R 12/7052 439/327 |
| 7,637,759 | B2 | 12/2009 | Kobayashi et al. | |
| 7,938,664 | B2 * | 5/2011 | Hsieh | H01R 12/707 439/326 |
| 8,475,195 | B2 | 7/2013 | Annis et al. | |
| 2013/0109214 | A1 * | 5/2013 | Ching | H01R 12/7005 439/328 |

FOREIGN PATENT DOCUMENTS

| | | |
|---|---|---|
| CN | 2927384 Y | 7/2007 |
| EP | 0600602 B1 | 10/1993 |

* cited by examiner

*Primary Examiner* — Xuong M Chung Trans

(57) ABSTRACT

A card guide module includes first and second rail assemblies mounted to a host circuit board proximate to a card edge connector. The rail assemblies each include a rail body having a base mounted to the host circuit board and a track extending from the base receiving a circuit card. The rail assemblies each include a positioning member held in the track having a side positioning arm engaging a corresponding side of the circuit card to position the circuit card relative to the card edge connector. The first and second side positioning arms are configured to locate the circuit card therebetween.

20 Claims, 5 Drawing Sheets

CARD EDGE CONNECTOR SYSTEM

BACKGROUND OF THE INVENTION

The subject matter herein relates generally to card edge connector systems.

Card edge connector systems are known that include circuit cards configured to be mated with the card edge connectors. Such card edge connector systems typically utilize the card edge connector to align and guide mating of the circuit cards in the card slot. However, the circuit cards may be improperly loaded into the card slot, such as at an angle, which may cause damage to the contacts of the card edge connector.

A need remains for a card edge connector system that provides guidance and alignment of circuit cards with card edge connectors for mating the circuit cards with the card edge connectors.

BRIEF DESCRIPTION OF THE INVENTION

In one embodiment, a card guide module for a card edge connector system is provided including first and second rail assemblies configured to be mounted to a host circuit board proximate to first and second sides of a card edge connector. The first rail assembly includes a first rail body having a first base configured to be mounted to the host circuit board and a first track extending from the first base configured to receive a circuit card. The first track has a front opening and a rear opening configured to face the card edge connector. The first rail assembly includes a first positioning member held in the track having a first side positioning arm configured to engage a first side of the circuit card to position the circuit card relative to the card edge connector. The second rail assembly includes a second rail body having a second base configured to be mounted to the host circuit board and a second track extending from the second base configured to receive the circuit card. The second track has a front opening and a rear opening configured to face the card edge connector. The second rail assembly has a second positioning member held in the track having a second side positioning arm configured to engage a second side of the circuit card to position the circuit card relative to the card edge connector. The first and second side positioning arms are configured to locate the circuit card therebetween.

In another embodiment, a card edge connector system is provided including a card edge connector configured to be mounted to a host circuit board. The card edge connector includes a housing having a card slot configured to receive a circuit card. The housing holds contacts configured to be terminated to the host circuit board and configured to be electrically connected to corresponding contact pads on the circuit card. The card edge connector system includes a card guide module having a first rail assembly and a second rail assembly configured to be mounted to the host circuit board proximate to the card edge connector to guide the circuit card into the card slot. The first rail assembly includes a first rail body having a first base configured to be mounted to the host circuit board and a first track extending from the first base configured to receive a circuit card. The first track has a front opening and a rear opening configured to face the card edge connector. The first rail assembly includes a first positioning member held in the track having a first side positioning arm configured to engage a first side of the circuit card to position the circuit card relative to the card edge connector. The second rail assembly includes a second rail body having a second base configured to be mounted to the host circuit board and a second track extending from the second base configured to receive the circuit card. The second track has a front opening and a rear opening configured to face the card edge connector. The second rail assembly has a second positioning member held in the track having a second side positioning arm configured to engage a second side of the circuit card to position the circuit card relative to the card edge connector. The first and second side positioning arms are configured to locate the circuit card therebetween.

In a further embodiment, a card edge connector system is provided including a circuit card having a mating end including a mating edge between an upper surface and a lower surface having contact pads on at least one of the upper and lower surfaces and having a first side and a second side opposite the first side having latching features located relative to the mating edge. The card edge connector system includes a card edge connector configured to be mounted to a host circuit board having a housing having a card slot receiving the mating edge of the circuit card and holding contacts configured to be terminated to the host circuit board and configured to be electrically connected to corresponding contact pads on the circuit card. The card edge connector system includes a card guide module having a first rail assembly and a second rail assembly configured to be mounted to the host circuit board proximate to the card edge connector to guide the circuit card into the card slot. The first rail assembly includes a first rail body having a first base configured to be mounted to the host circuit board and a first track extending from the first base configured to receive a circuit card. The first track has a front opening and a rear opening configured to face the card edge connector. The first rail assembly includes a first positioning member held in the track having a first side positioning arm configured to engage a first side of the circuit card to position the circuit card relative to the card edge connector. The first side positioning arm has a first latch engaging the latching feature on the first side of the circuit card to locate the circuit card relative to the card edge connector. The second rail assembly includes a second rail body having a second base configured to be mounted to the host circuit board and a second track extending from the second base configured to receive the circuit card. The second track has a front opening and a rear opening configured to face the card edge connector. The second rail assembly has a second positioning member held in the track having a second side positioning arm configured to engage a second side of the circuit card to position the circuit card relative to the card edge connector. The second side positioning arm has a second latch engaging the latching feature on the second side of the circuit card to locate the circuit card relative to the card edge connector.

DETAILED DESCRIPTION OF THE INVENTION

Figure 1:
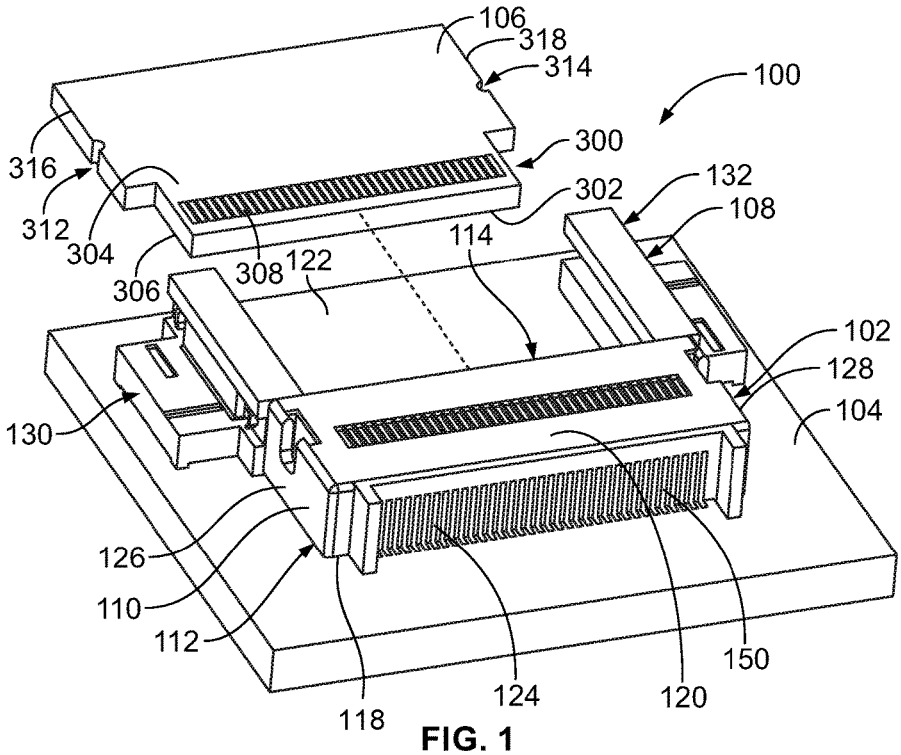
FIG. 1 is a rear perspective view of a card edge connector system in accordance with an exemplary embodiment.
Figure 2:
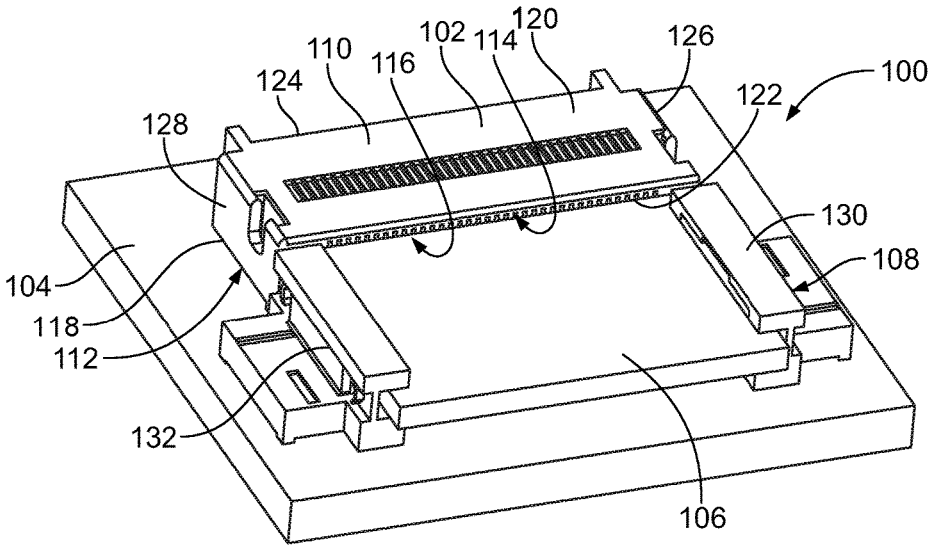
FIG. 2 is a front perspective view of a card edge connector system in accordance with an exemplary embodiment.

FIG. 1 is a rear perspective view of a card edge connector system 100 in accordance with an exemplary embodiment. FIG. 2 is a front perspective view of a card edge connector system 100 in accordance with an exemplary embodiment. The card edge connector system 100 includes a card edge connector 102 mounted to a host circuit board 104. The card edge connector system 100 includes a circuit card 106 coupled to the card edge connector 102. FIG. 1 shows the circuit card 106 poised for coupling to the card edge connector 102. FIG. 2 shows the circuit card 106 coupled to the card edge connector 102.

In an exemplary embodiment, the card edge connector system 100 includes a card guide module 108 for guiding the circuit card 106 into the card edge connector 102. The card guide module 108 is mounted to the host circuit board 104 proximate to the card edge connector 102. The card guide module 108 includes a first rail assembly 130 and a second rail assembly 132. In an exemplary embodiment, the first and second rail assemblies 130, 132 are separate and discrete from each other and independently mounted to the host circuit board 104 proximate to the card edge connector 102. Optionally, the first and second rail assemblies 130, 132 may be similar to each other and include similar features identified with like reference numerals. For example, the first and second rail assemblies 130, 132 may be mirrored versions of each other. In various embodiments, the first and second rail assemblies 130, 132 may be identical to each other. Optionally, the card guide module 108 aligns the circuit card 106 with the card edge connector 102 prior to loading the circuit card 106 in the card edge connector 102 to prevent damaging the contacts of the card edge connector 102 during mating. Optionally, the card guide module 108 may be used to secure or retain the circuit card 106 in the card edge connector 102. The card guide module 108 may be used with different types and/or different size card edge connectors 102. The card guide module 108 may be used with different types and/or different size circuit cards 106.

The card edge connector 102 includes a housing 110 having a mounting end 112 mounted to the host circuit board 104 and a mating end 114 having a card slot 116 that receives the circuit card 106. In the illustrated embodiment, the mounting end 112 is provided at a bottom 118 of the housing 110. The housing 110 includes a top 120 opposite the bottom 118. In the illustrated embodiment, the mating end 114 is provided at a front 122 of the housing 110. The housing 110 includes a rear 124 opposite the front 122. In an exemplary embodiment, the housing 110 extends between a first side 126 and a second side 128.

The circuit card 106 includes a mating end 300 having a mating edge 302 between an upper surface 304 and an opposite lower surface 306. The circuit card 106 includes contact pads 308 on the upper surface 304 and the lower surface 306. The contact pads 308 on the upper surface 304 may be referred to hereinafter as upper contact pads and the contact pads 308 on the lower surface 306 be referred to hereinafter as lower contact pads. The contact pads 308 are provided proximate to the mating edge 302. The contact pads 308 are configured to be electrically connected to corresponding contacts of the card edge connector 102. In an exemplary embodiment, the circuit card 106 includes latching features 312, 314 at opposite first and second sides 316, 318 of the circuit card 106. The latching features 312, 314 are configured to be engaged by the card guide module 108 to secure the circuit card 106 in the card edge connector 102.

The card edge connector 102 includes a plurality of upper contacts 150 arranged in a row along the upper side of the card slot 116 and a plurality of lower contacts 152 (shown in FIG. 5) arranged in a row along the lower side of the card slot 116. The upper contacts 150 are held in the housing 110 for mating with the circuit card 106 and the host circuit board 104. The lower contacts 152 are held in the housing 110 for mating with the circuit card 106 and the host circuit board 104. In an exemplary embodiment, the upper contacts 150 are configured to be mounted to the housing 110 at the rear 124 and the lower contacts 152 are configured to be mounted to the housing 110 at the front 122. Other arrangements are possible in alternative embodiments.

Figure 3:
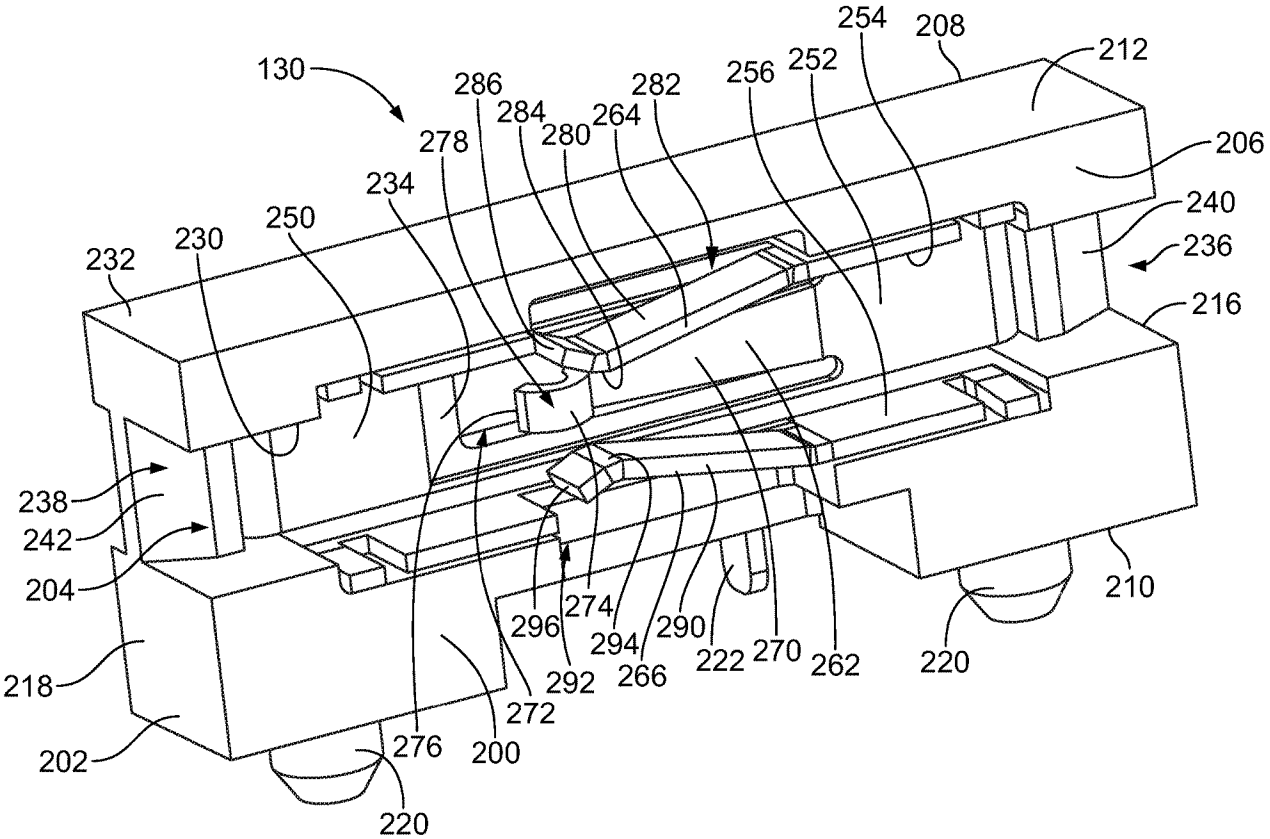
FIG. 3 is a perspective view of a rail assembly of a card guide module of the card edge connector system in accordance with an exemplary embodiment.

FIG. 3 is a perspective view of the first rail assembly 130. The second rail assembly 132 may be similar to the first rail assembly 130 and like components may be identified with like reference numerals herein. Components described herein may be identified generally without a "first" or "second" designation or may be identified specifically with the "first" designation when identifying components of the first rail assembly 130 or with the "second" designation when identifying components of the second rail assembly 132.

The rail assembly 130 includes a rail body 200 having a base 202 (further shown in FIG. 5) configured to be mounted to the host circuit board 104 and a track 204 extending from the base 200. The rail body 200 extends between an inner side 206 and an outer side 208 (further shown in FIG. 5). The inner side 206 generally faces the circuit card 106. The rail body 200 includes a bottom 210 and a top 212 opposite the bottom 210. In the illustrated embodiment, the base 202 is generally provided at or near the bottom 210 and the track 204 is generally provided at or near the top 212. The bottom 210 is configured to be mounted to the host circuit board 104. The rail body 200 extends between a front 216 and a rear 218.

In an exemplary embodiment, the rail assembly 130 includes alignment post 220 extending from the base 202. The alignment posts 220 are configured to be received in the openings in the host circuit board 104 to position the rail assembly 130 relative to the host circuit board 104. In the illustrated embodiment, the rail assembly 130 includes two alignment posts 220; however, the rail assembly 130 may include any number of alignment posts 220.

In an exemplary embodiment, the rail assembly 130 includes a mounting tab 222 for mounting the rail assembly 130 to the host circuit board 104. The mounting tab 222 is secured to the base 202 and extends from the bottom 210. The mounting tab 222 may be soldered to the host circuit board 104 to secure the rail assembly 130 to the host circuit board 104. Alternatively, the mounting tab 222 may be secured to the host circuit board 104 by other means, such as being press-fit to the host circuit board 104. The rail assembly 130 may be secured to the host circuit board 104 by other means, such as being secured using a fastener, such as a threaded fastener in alternative embodiments.

In an exemplary embodiment, the track 204 is formed in the rail body 200 along the inner side 206. The track 204 includes an upper surface 230 and a lower surface 232 opposite the upper surface 230. The track 204 has an inner wall 234 between the upper surface 230 and the lower surface 232. The inner wall 234 is recessed from the inner side 206 of the rail body 200. The track 204 is configured to receive the circuit card 106 between the upper surface 230 and the lower surface 232. In an exemplary embodiment, the track 204 includes a front opening 236 at the front 216 and a rear opening 238 at the rear 218. The circuit card 106 is configured to be received in the track 204 through the front opening 236. In an exemplary embodiment, the rail body 200 includes a front ramp 240 at the front opening 236 and a rear ramp 242 at the rear opening 238. The front ramp 240 is configured to guide the circuit card 106 into the front opening 236 and into the track 204.

The rail assembly 130 includes a positioning member 250 in the track 204. In an exemplary embodiment, the positioning member 250 is separate and discrete from the rail body 200 and coupled thereto. For example, the positioning member 250 may be manufactured from a different material as the rail body 200. Optionally, the rail body 200 may be manufactured from a plastic material that is molded, whereas the positioning member 250 may be manufactured from a metal material that is stamped and formed. As such, the rail body 200 may be manufactured in an inexpensive cost-effective manner, whereas the positioning member 250 may be manufactured more robustly. Optionally, the positioning member 250 may be held in the rail body 200 by an interference fit; however, the rail assembly 130 may include other components used to secure the positioning member 250 in the rail body 200. In other various embodiments, the positioning member 250 may be integral with the rail body 200. For example, the positioning member 250 may be manufactured with the rail body 200 such as molded, die cast or otherwise manufactured as a unitary body.

The positioning member 250 includes a main wall 252 extending along the inner wall 234 of the track 204 and end walls 254, 256 extending from the main wall 252. The end wall 254 extends along the upper surface 230 and the end wall 256 extends along the lower surface 232. The rail body 200 may include cutouts or pockets to receive the walls 252, 254 and/or 256. The main wall 252 includes a side positioning arm 262 extending therefrom. The upper end wall 254 includes an upper positioning arm 264 extending therefrom. The lower end wall 256 includes a lower positioning arm 266 extending therefrom. The positioning arms 262, 264, 266 are used to position the circuit card 106 within the track 204. In an exemplary embodiment, the side positioning arm 262 controls a horizontal or side to side position of the circuit card 106 within the track 204. The upper and lower positioning arms 264, 266 control a vertical position of the circuit card 106 within the track 204.

In an exemplary embodiment, the side positioning arm 262 is stamped and formed from the main wall 252. The side positioning arm 262 includes a spring beam 270 configured to be spring loaded against the circuit card 106. In an exemplary embodiment, the spring beam 270 is deflectable. Optionally, the rail body 200 may include a pocket 272 behind the spring beam 270 to allow the spring beam 270 to deflect into the pocket 272. The spring beam 270 includes a protrusion 274 at or near a distal end 276 of the spring beam 270. The protrusion 274 is defined by a bump in the spring beam 270 extending into the track 204 toward the circuit card 106 (when it is received in track 204). The protrusion 274 may be curved. In an exemplary embodiment, the spring beam 270 is bent or angled relative to the main wall 252 to engage the circuit card 106 when received in the track 204. In an exemplary embodiment, the side positioning arm 262 includes a latch 278 configured to engage the circuit card 106 to latch of the secure the circuit card 106 relative to the rail assembly 130. In the illustrated embodiment, the latch 278 is defined by the protrusion 274.

In an exemplary embodiment, the upper positioning arm 264 is stamped and formed from the upper end wall 254. The upper positioning arm 264 includes a spring beam 280 configured to be spring loaded against the circuit card 106. In an exemplary embodiment, the spring beam 280 is deflectable. Optionally, the rail body 200 may include a pocket 282 behind the spring beam 280 to allow the spring beam 280 to deflect into the pocket 282. The spring beam 280 includes a protrusion 284 at or near a distal end 286 of the spring beam 280. The protrusion 284 is defined by a bump in the spring beam 280 extending into the track 204 toward the circuit card 106 (when it is received in track 204). The protrusion 284 may be curved. In an exemplary embodiment, the spring beam 280 is bent or angled relative to the end wall 254 to engage the circuit card 106 when received in the track 204.

In an exemplary embodiment, the lower positioning arm 266 is stamped and formed from the lower end wall 256. The lower positioning arm 266 includes a spring beam 290 configured to be spring loaded against the circuit card 106. In an exemplary embodiment, the spring beam 290 is deflectable. Optionally, the rail body 200 may include a pocket 292 behind the spring beam 290 to allow the spring beam 290 to deflect into the pocket 292. The spring beam 290 includes a protrusion 294 at or near a distal end 296 of the spring beam 290. The protrusion 294 is defined by a bump in the spring beam 290 extending into the track 204 toward the circuit card 106 (when it is received in track 204). The protrusion 294 may be curved. In an exemplary embodiment, the spring beam 290 is bent or angled relative to the end wall 256 to engage the circuit card 106 when received in the track 204.

Figure 4:
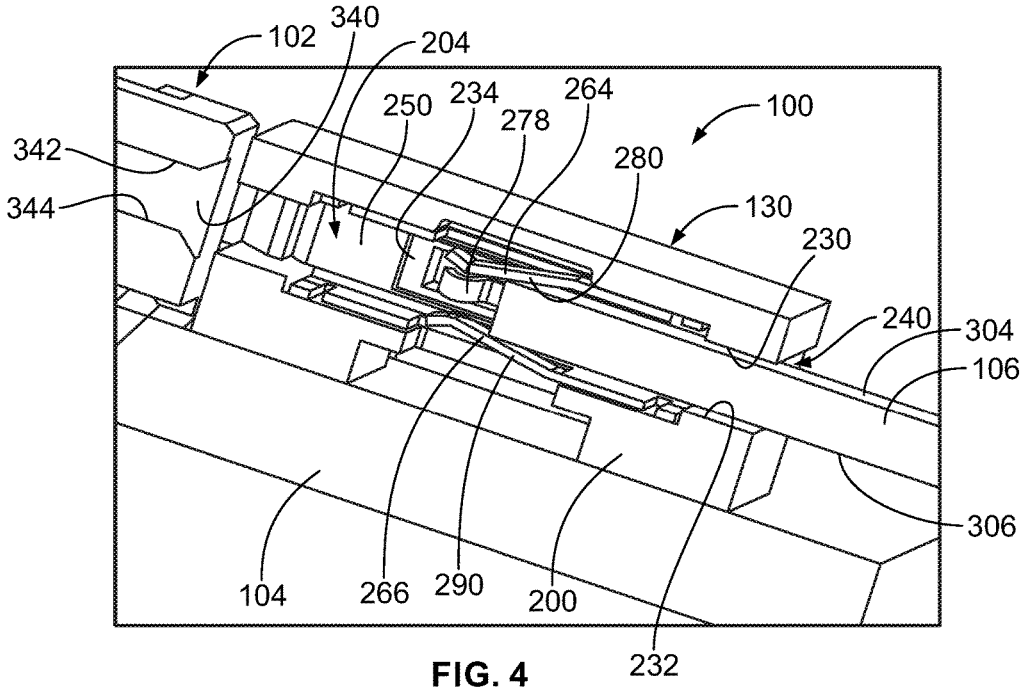
FIG. 4 is a partial sectional view of a portion of the card edge connector system in accordance with an exemplary embodiment.
Figure 6:
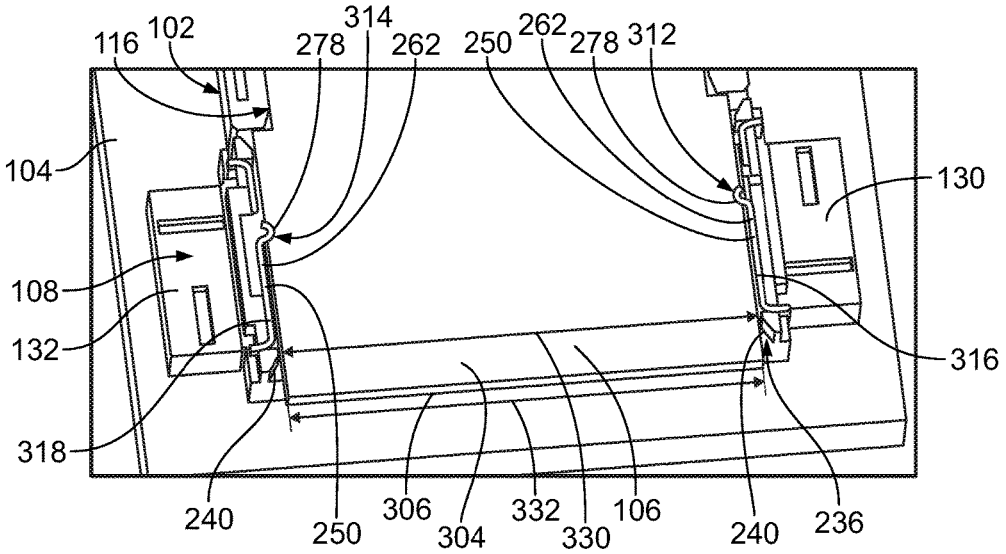
FIG. 6 is a partial sectional view of a portion of the card edge connector system in accordance with an exemplary embodiment showing a circuit card mated in a card edge connector.
Figure 5:
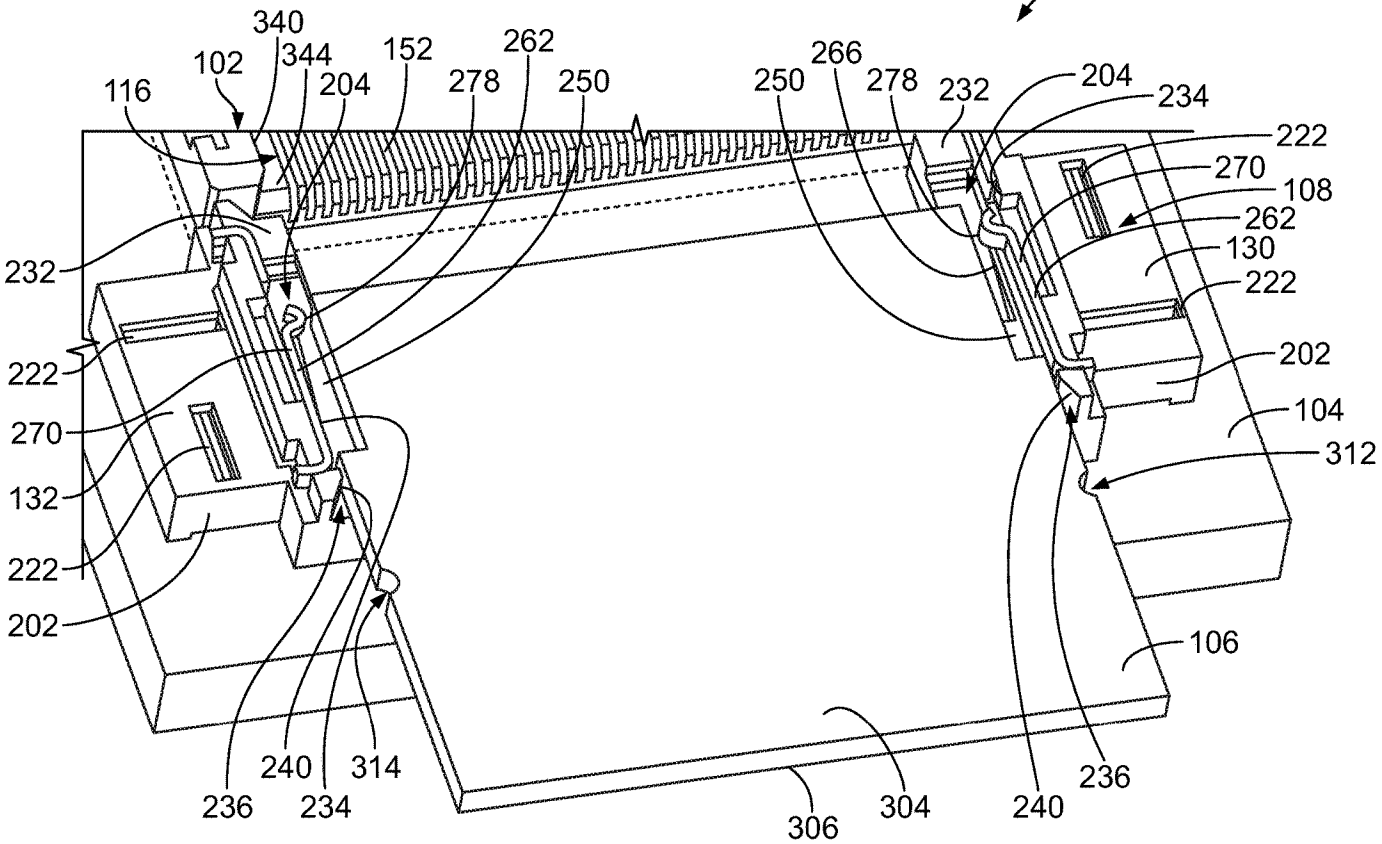
FIG. 5 is a partial sectional view of a portion of the card edge connector system in accordance with an exemplary embodiment showing a circuit card being loaded into the card guide module.

FIG. 4 is a partial sectional view of a portion of the card edge connector system 100 showing the circuit card 106 being loaded into the first rail assembly 130 forward of the card edge connector 102. FIG. 5 is a partial sectional view of a portion of the card edge connector system 100 showing the circuit card 106 being loaded into the card guide module 108 forward of the card edge connector 102. FIG. 6 is a partial sectional view of a portion of the card edge connector system 100 showing the circuit card 106 mated in the card edge connector 102.

The card guide module 108 guides the circuit card 106 into the card edge connector 102 during mating. For example, the circuit card 106 is loaded between the first and second rail assemblies 130, 132 such that the first and second rail assemblies 130, 132 align the circuit card 106 with the card edge connector 102 to prevent improper loading of the circuit card 106 into the card slot 116. Optionally, the first track 204 of the first rail assembly 130 is oriented parallel to the second track 204 of the second rail assembly 132. The first rail assembly 130 is independent and discrete from the second rail assembly 132 such that the first rail assembly 130 is variably positionable on the host circuit board 104 relative to the second rail assembly 132. The first rail assembly 130 is configured to be mounted to the host circuit board 104 a separation distance 330 from the second rail assembly 132 corresponding to a width 332 of the circuit card 106 between the first and second sides 316, 318.

During assembly, the card edge connector 102 is mounted to the host circuit board 104. The card guide module 108 is mounted to the host circuit board 104 forward of the card edge connector 102. Optionally, the rail assemblies 130, 132 may be positioned immediately forward of the card edge connector 102. In alternative embodiments, the rail assemblies 130, 132 may be spaced a distance forward of the card edge connector 102 for supporting the circuit card 106 further from the card edge connector 102. The rail assemblies 130, 132 are mounted to the host circuit board 104 using the mounting tabs 222. In the illustrated embodiment, each rail assembly 130, 132 includes a pair of mounting tabs 222 in the corresponding base 202. Optionally, the mounting tabs 222 may have different orientations. For example, in the illustrated embodiment shown in FIG. 5, the first rail assembly 130 includes two mounting tabs 222 oriented perpendicular to each other with one of the mounting tabs 222 extending parallel to the loading direction of the circuit card 106 into the card guide module 108 and the other mounting tab 222 extending perpendicular to the loading direction of the circuit card 106 into the card guide module 108. Other orientations are possible in alternative embodiments. Having the mounting tabs 222 at different orientations may provide a more secure connection to the host circuit board 104 such as by securing against stresses or forces acting in different directions.

During mating, the circuit card 106 is initially loaded into the card guide module 108 to position the circuit card 106 for loading into the card edge connector 102. The circuit card 106 is loaded into the first and second tracks 204 of the first and second rail assemblies 130, 132 to generally align the circuit card 106 with the card edge connector 102. The circuit card 106 is loaded into the tracks 204 through the front openings 236. The front ramps 240 gather the circuit card 106 and force the circuit card 106 to be generally centered position between the first and second rail assemblies 130, 132. For example, when initially loaded into the card guide module 108, the first and second sides 316, 318 of the circuit card 106 are positioned between the inner walls 234 of the tracks 204 of the first and second rail assemblies 130, 132. The lower surfaces 232 of the tracks 204 of the first and second rail assemblies 130, 132 support the lower surface 306 of the circuit card 106. The upper surfaces 230 of the tracks 204 of the first and second rail assemblies 130, 132 are located above the upper surface 304 of the circuit card 106 to contain the circuit card 106 in the tracks 204.

During mating, as the circuit card 106 is advanced toward the card edge connector 102, the positioning members 250 of the first and second rail assemblies 130, 132 are used to position the circuit card 106 within the card guide module 108 for loading into the card edge connector 102. For example, as the circuit card 106 is advanced, the side positioning arms 262 engage the first and second sides 316, 318 of the circuit card 106 to position the circuit card 106 relative to the card edge connector 102. The side positioning arms 262 of the first and second rail assemblies 130, 132 locate the circuit card 106 therebetween. The first and second spring beams 270 of the first and second rail assemblies 130, 132 allow side to side floating movement of the circuit card 106 therebetween. For example, the first and second spring beams 270 may hold the first and second sides 316, 318 of the circuit card 106 spaced apart from the first and second inner walls 234 of the tracks 204 to allow a limited amount of side to side floating movement of the circuit card 106 between the first and second rail assemblies 130, 132. The floating movement allows the circuit card 106 to be coarsely aligned by the card guide module 108 and finely aligned by the card edge connector 102. For example, when the circuit card 106 is loaded into the card slot 116, alignment surfaces 340 of the card edge connector 102 may adjust the side to side position of the circuit card 106 against the holding spring forces of the spring beams 270 to allow some side to side movement of the circuit card 106 within the card slot 116. The deflectable first spring beam 270 imparts a spring force on the circuit card 106 in the direction of the second side positioning arm 262 and the deflectable second spring beam 270 imparts a spring force on the circuit card 106 in the direction of the first side positioning arm 262.

The upper positioning arms 264 of the first and second rail assemblies 130, 132 oppose the corresponding lower positioning arms 266 of the first and second rail assemblies 130, 132. The upper positioning arms 264 and the lower positioning arms 266 control the vertical position of the circuit card 106 within the tracks 204. As the circuit card 106 is advanced, the upper and lower positioning arms 264, 266 engage the upper and lower surfaces 304, 306 of the circuit card 106 to position the circuit card 106 relative to the card edge connector 102. The upper and lower positioning arms 264, 266 of the first and second rail assemblies 130, 132 locate the circuit card 106 therebetween. The deflectable spring beams 280, 290 of the first and second rail assemblies 130, 132 allow vertical floating movement of the circuit card 106 within the first and second rail assemblies. 130, 132. For example, the upper spring beams 280 may hold the upper surface 304 of the circuit card 106 spaced apart from the upper surface 230 of the tracks 204 and the lower spring beams 290 may hold the lower surface 306 of the circuit card 106 spaced apart from the lower surface 232 of the tracks 204 to allow a limited amount of vertical floating movement of the circuit card 106 between the upper and lower surfaces 230, 232 of the rail assemblies 130, 132. The floating movement allows the circuit card 106 to be coarsely aligned by the card guide module 108 and finely aligned by the card edge connector 102. For example, when the circuit card 106 is loaded into the card slot 116, alignment surfaces 342, 344 of the card edge connector 102 may adjust the vertical position of the circuit card 106 against the holding spring forces of the spring beams 280, 290, respectively, to allow some vertical movement of the circuit card 106 within the card slot 116. The deflectable upper spring beams 280 impart spring forces on the circuit card 106 in the direction of the corresponding deflectable lower spring beams 290 and the deflectable lower spring beams 290 impart spring forces on the circuit card 106 in the direction of the upper spring beams 280.

When fully mated (FIG. 6), the first and second latches 278 of the first and second rail assemblies 130, 132 engage corresponding latching features 312, 314 at the first and second sides 316, 318 of the circuit card 106. The latches 278 are configured to be latchably secured to the first and second side 316, 318 of the circuit card 106 to hold the circuit card 106 in the card edge connector 102. The latches 278 retain the circuit card 106 in the mated position. The latches 278 prevent inadvertent pullout of the circuit card 106 from the card edge connector 102. The latching forces may be overcome by pulling on the circuit card 106 with enough force to cause the latches 278 to disengage from the latching features 312, 314 and deflect the spring beams 270 outward, thus releasing the circuit card 106 from the card edge connector 102.

Figure 7:
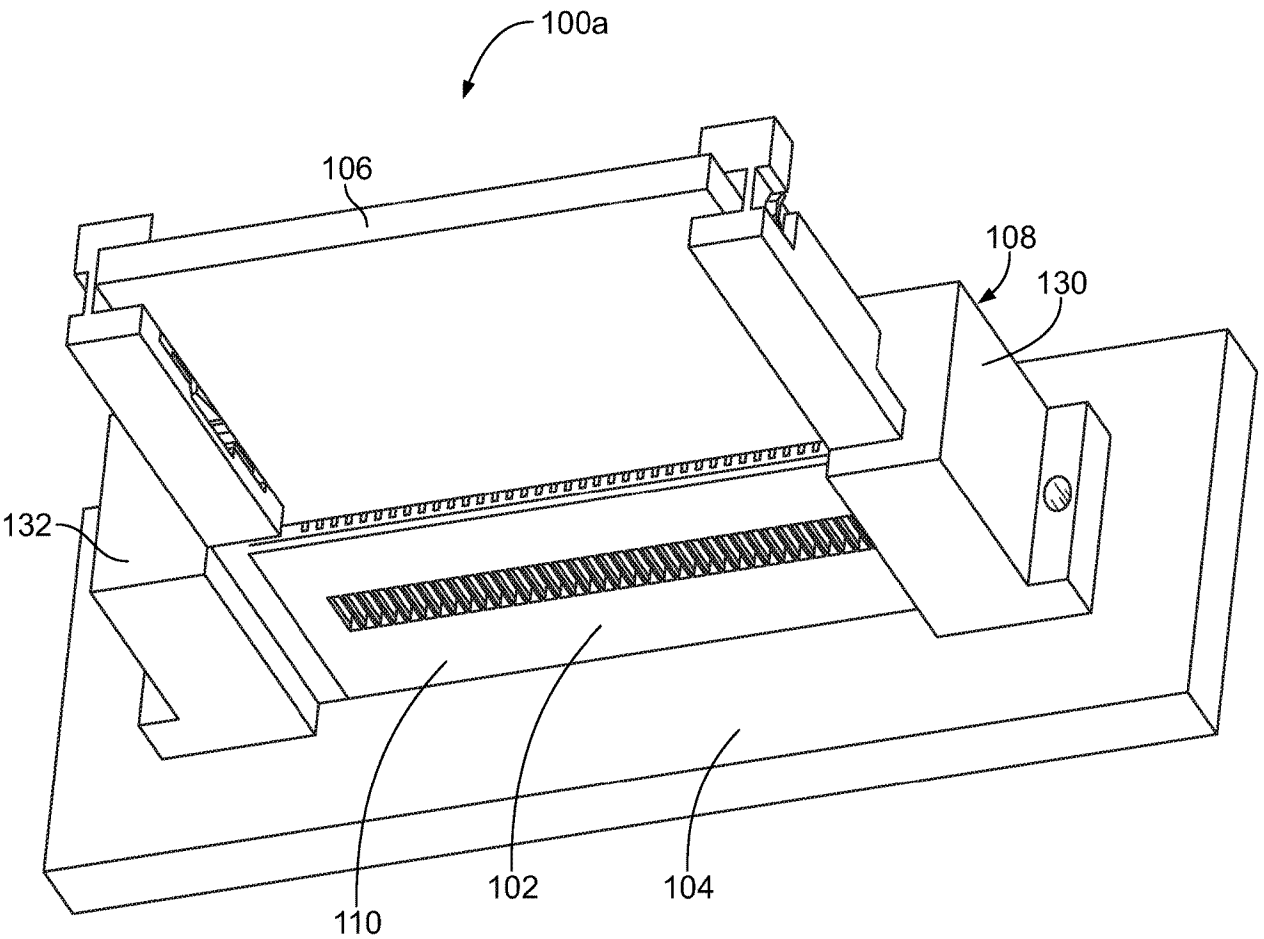
FIG. 7 is a perspective view of the card edge connector system in accordance with an exemplary embodiment.

FIG. 7 is a perspective view of the card edge connector system 100*a* in accordance with an exemplary embodiment. The card edge connector system 100*a* is similar to the card edge connector system 100 shown in FIGS. 1 and 2;

however, the card edge connector system 100*a* is oriented vertically rather than horizontally. Like components are identified with like reference numerals between the embodiments. The card edge connector 102 and the card guide module 108 are configured to receive the circuit card 106 in a vertical loading direction generally perpendicular to the host circuit board 104. The first and second rail assemblies 130, 132 have a different shape for mounting to the host circuit board 104 including support structure that extends along the housing 110 of the card edge connector 102 for mounting to the host circuit board 104. The first and second rail assemblies 130, 132 are coupled to the host circuit board at the bottom ends of the rail assemblies 130, 132, such as using mounting posts, fasteners, solder tabs and the like.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

What is claimed is:

1. A card guide module for a card edge connector system comprising:

a first rail assembly configured to be mounted to a host circuit board proximate a first side of a card edge connector, the first rail assembly comprising a first rail body having a first base configured to be mounted to the host circuit board and a first track extending from the first base configured to receive a circuit card, the first track having a front opening and a rear opening, the rear opening configured to face the card edge connector, the first rail assembly having a first positioning member held in the track, the first positioning member having a first side positioning arm configured to engage a first side of the circuit card to position the circuit card relative to the card edge connector; and a second rail assembly configured to be mounted to the host circuit board proximate a second side of a card edge connector, the second rail assembly comprising a second rail body having a second base configured to be mounted to the host circuit board and a second track extending from the second base configured to receive the circuit card, the second track having a front opening and a rear opening, the rear opening configured to face the card edge connector, the second rail assembly having a second positioning member held in the track, the second positioning member having a second side positioning arm configured to engage a second side of the circuit card to position the circuit card relative to the card edge connector;

wherein the first and second side positioning arms are configured to locate the circuit card therebetween.

2. The card guide module of claim 1, wherein the first rail assembly is independent and discrete from the second rail assembly such that the first rail assembly is variably positionable on the host circuit board relative to the second rail assembly.

3. The card guide module of claim 2, wherein the first rail assembly is configured to be mounted to the host circuit board a separation distance from the second rail assembly corresponding to a width of the circuit card.

4. The card guide module of claim 1, wherein the first side positioning arm includes a deflectable first spring beam and the second side positioning arm includes a deflectable second spring beam, the first and second spring beams allowing side to side floating movement of the circuit card therebetween.

5. The card guide module of claim 1, wherein the first side positioning arm includes a deflectable first spring beam configured to impart a spring force on the circuit card in the direction of the second side positioning arm, the second side positioning arm includes a deflectable second spring beam configured to impart a spring force on the circuit card in the direction of the first side positioning arm.

6. The card guide module of claim 1, wherein the first side positioning arm includes a latch configured to be latchably secured to the first side of the circuit card to hold the circuit card in the card edge connector, the second side positioning arm includes a latch configured to be latchably secured to the second side of the circuit card to hold the circuit card in the card edge connector.

7. The card guide module of claim 1, wherein the first track includes a ramp at the front opening to guide the circuit card into the first track, the second track including a ramp at the front opening to guide the circuit card into the second track.

8. The card guide module of claim 1, wherein the first positioning member includes an upper positioning arm and a lower positioning arm opposing the upper positioning arm, the second positioning member includes an upper positioning arm and a lower positioning arm opposing the upper positioning arm, the upper positioning arms and the lower positioning arms controlling a vertical position of the circuit card.

9. The card guide module of claim 8, wherein the upper positioning arm of the first positioning member includes a deflectable spring beam, the lower positioning arm of the first positioning member including a deflectable spring beam, the upper positioning arm of the second positioning member includes a deflectable spring beam, the lower positioning arm of the second positioning member includes a deflectable spring beam, the deflectable spring beams allowing vertical floating movement of the circuit card within the first and second rail assemblies.

10. The card guide module of claim 8, wherein the upper positioning arm of the first positioning member includes a deflectable spring beam configured to impart a spring force on the circuit card in the direction of the lower positioning arm of the first positioning member and the lower positioning arm of the first positioning member includes a deflectable spring beam configured to impart a spring force on the circuit card in the direction of the upper positioning arm of the first positioning member, and wherein the upper positioning arm of the second positioning member includes a deflectable spring beam configured to impart a spring force on the circuit card in the direction of the lower positioning arm of the second positioning member and the lower positioning arm of the second positioning member includes a deflectable spring beam configured to impart a spring force on the circuit card in the direction of the upper positioning arm of the second positioning member.

11. The card guide module of claim 8, wherein the first track includes an upper surface and a lower surface and the second track includes an upper surface and a lower surface, the upper positioning arm of the first positioning member including a deflectable spring beam configured to hold the circuit card spaced apart from the upper surface of the first track, the lower positioning arm of the first positioning member including a deflectable spring beam configured to hold the circuit card spaced apart from the lower surface of the first track, the upper positioning arm of the second positioning member including a deflectable spring beam configured to hold the circuit card spaced apart from the upper surface of the second track, the lower positioning arm of the second positioning member including a deflectable spring beam configured to hold the circuit card spaced apart from the lower surface of the second track.

12. The card guide module of claim 1, wherein the first track is oriented parallel to the second track.

13. A card edge connector system comprising:

a card edge connector configured to be mounted to a host circuit board, the card edge connector comprising a housing having a card slot configured to receive a circuit card, the housing holding contacts configured to be terminated to the host circuit board and configured to be electrically connected to corresponding contact pads on the circuit card; and a card guide module comprising a first rail assembly and a second rail assembly configured to be mounted to the host circuit board proximate to the card edge connector to guide the circuit card into the card slot;

the first rail assembly comprising a first rail body having a first base configured to be mounted to the host circuit board and a first track extending from the first base configured to receive the circuit card, the first track having a front opening and a rear opening, the rear opening facing the card edge connector, the first rail assembly having a first positioning member held in the track, the first positioning member having a first side positioning arm configured to engage a first side of the circuit card to position the circuit card relative to the card edge connector;

the second rail assembly comprising a second rail body having a second base configured to be mounted to the host circuit board and a second track extending from the second base configured to receive the circuit card, the second track having a front opening and a rear opening, the rear opening facing the card edge connector, the second rail assembly having a second positioning member held in the track, the second positioning member having a second side positioning arm configured to engage a second side of the circuit card to position the circuit card relative to the card edge connector;

wherein the first and second side positioning arms are configured to locate the circuit card therebetween.

14. The card edge connector system of claim 13, wherein the first rail assembly is independent and discrete from the second rail assembly such that the first rail assembly is variably positionable on the host circuit board relative to the second rail assembly.

15. The card edge connector system of claim 13, wherein the first side positioning arm includes a deflectable first spring beam and the second side positioning arm includes a deflectable second spring beam, the first and second spring beams allowing side to side floating movement of the circuit card therebetween.

16. The card edge connector system of claim 13, wherein the first side positioning arm includes a latch configured to be latchably secured to the first side of the circuit card to hold the circuit card in the card edge connector, the second side positioning arm includes a latch configured to be latchably secured to the second side of the circuit card to hold the circuit card in the card edge connector.

17. The card edge connector system of claim 13, wherein the first positioning member includes an upper positioning arm and a lower positioning arm opposing the upper positioning arm, the second positioning member includes an upper positioning arm and a lower positioning arm opposing the upper positioning arm, the upper positioning arms and the lower positioning arms controlling a vertical position of the circuit card.

18. The card edge connector system of claim 17, wherein the upper positioning arm of the first positioning member includes a deflectable spring beam, the lower positioning arm of the first positioning member including a deflectable spring beam, the upper positioning arm of the second positioning member includes a deflectable spring beam, the lower positioning arm of the second positioning member includes a deflectable spring beam, the deflectable spring beams allowing vertical floating movement of the circuit card within the first and second rail assemblies.

19. A card edge connector system comprising:

a circuit card having a mating end including a mating edge between an upper surface and a lower surface, the circuit card having contact pads on at least one of the upper and lower surfaces, the circuit card having a first side and a second side opposite the first side, the first side having a latching feature located relative to the mating edge and the second side having a latching feature located relative to the mating edge;

a card edge connector configured to be mounted to a host circuit board, the card edge connector comprising a housing having a card slot receiving the mating edge of the circuit card, the housing holding contacts configured to be terminated to the host circuit board and configured to be electrically connected to corresponding contact pads on the circuit card; and a card guide module comprising a first rail assembly and a second rail assembly configured to be mounted to the host circuit board proximate to the card edge connector to guide the circuit card into the card slot;

the first rail assembly comprising a first rail body having a first base configured to be mounted to the host circuit board and a first track extending from the first base receiving the circuit card, the first track having a front opening and a rear opening, the rear opening facing the card edge connector, the first rail assembly having a first positioning member held in the track, the first positioning member having a first side positioning arm engaging the first side of the circuit card to position the circuit card relative to the card edge connector, the first side positioning arm having a first latch engaging the latching feature on the first side of the circuit card to locate the circuit card relative to the card edge connector;

the second rail assembly comprising a second rail body having a second base configured to be mounted to the host circuit board and a second track extending from the second base receiving the circuit card, the second track having a front opening and a rear opening, the rear opening facing the card edge connector, the second rail assembly having a second positioning member held in the track, the second positioning member having a second side positioning arm engaging a second side of the circuit card to position the circuit card relative to the card edge connector, the second side positioning arm having a second latch engaging the latching feature on the second side of the circuit card to locate the circuit card relative to the card edge connector.

20. The card edge connector system of claim 19, wherein the first positioning member includes an upper positioning arm and a lower positioning arm opposing the upper positioning arm, the second positioning member includes an upper positioning arm and a lower positioning arm opposing the upper positioning arm, the upper positioning arms and the lower positioning arms controlling a vertical position of the circuit card.

* * * * *